US007255829B1

(12) United States Patent
Peter et al.

(10) Patent No.: US 7,255,829 B1
(45) Date of Patent: Aug. 14, 2007

(54) METHOD AND APPARATUS FOR TREATMENT OF METALLIC WORKPIECES

(75) Inventors: Wolfgang Peter, Emmerich (DE); Bernd Edenhofer, Kleve (DE); Jan-Willem Bouwman, Babberich (DE)

(73) Assignee: Ipsen International GmbH (DE)

( * ) Notice: Subject to any disclaimer, the term of this patent is extended or adjusted under 35 U.S.C. 154(b) by 1165 days.

(21) Appl. No.: 09/651,797

(22) Filed: Aug. 30, 2000

(30) Foreign Application Priority Data

Apr. 14, 2000 (EP) ..... 00108203

(51) Int. Cl.
*C21D 1/62* (2006.01)
*C21D 1/767* (2006.01)

(52) U.S. Cl. ..... 266/250; 266/251; 266/259; 432/59; 432/77; 432/82; 432/152; 432/143; 432/176

(58) Field of Classification Search ..... 266/250, 266/251, 259; 432/59, 152, 143, 176, 77, 432/82

See application file for complete search history.

(56) References Cited

U.S. PATENT DOCUMENTS 4,653,732 A * 3/1987 Wunning et al. ..... 266/250

FOREIGN PATENT DOCUMENTS

| | | | |
|---|---|---|---|
| DE | 3028901 | | 2/1982 |
| DE | 3200577 | | 7/1983 |
| DE | 94002223 | * | 4/1994 |
| DE | G 94 00 222.3 | | 4/1994 |
| DE | 29603022 | | 5/1996 |
| WO | WO 00/18972 | | 4/2000 |

OTHER PUBLICATIONS

Article, XP-000755094 Carl Hanser Verlag, München, 53 (1998) 2, pp. 102-107.

* cited by examiner

*Primary Examiner*—S. Ip
(74) *Attorney, Agent, or Firm*—Robert W Becker & Associates; Robert W Becker

(57) ABSTRACT

A method and an apparatus for the thermal treatment of metallic workpieces with which gas quenching can be obtained that is low in distortion, even for workpieces with an undulating shape or workpieces that are projectingly stackable are provided. In accordance with the method, after being heated the workpieces are cooled in a quenching chamber with a quenching gas, whereby the quenching gas is intentionally caused to flow around the workpieces by means of guide channels that have a closed lateral surface and that enclose the workpieces along the direction of flow of the quenching gas. The apparatus comprises a quenching chamber in which the workpieces can be cooled with a quenching gas, and wherein guide channels are provided to ensure that the quenching gas flows around the workpieces, the guide channels having a closed lateral surface and enclosing the workpieces along the direction of flow of the quenching gas.

14 Claims, 4 Drawing Sheets

METHOD AND APPARATUS FOR TREATMENT OF METALLIC WORKPIECES

BACKGROUND OF THE INVENTION

The present invention relates to a method for the thermal treatment of metallic workpieces, in particular workpieces with an overset or undulating shape or workpieces that are projectingly stackable, in which method the workpieces, after being heated, are cooled in a quenching chamber with a quenching gas. The present invention furthermore relates to an apparatus with which such a method can be performed.

Metallic workpieces undergo thermal treatment in order to produce defined workpiece properties, for example, a high degree of hardness or sufficient resistance to wear. The result of the thermal treatment is a change in the structure of the workpiece, for example, a conversion of the cubic, surface-centered γ-structure of carbon-rich austenite plates into the cubic space-centered α-structure of ferrite plates. In addition to temperature and original structure, particularly important in terms of the results of the treatment are the speed at which the heated workpieces are cooled and the quenching means used. Quenching means primarily used are gas, oil, and Water (given in order of increasing abruptness).

When gas quenching is used, relatively high speed is needed in order to achieve a quenching intensity that approaches the quenching intensity of oil or water quenching. For this purpose, it is known to provide nozzles with which correspondingly high gas speeds and therefore generally sufficient heat transmission values of greater than 1000 $W/m^2K$ can be achieved. An apparatus provided with nozzles for quenching metallic workpieces is disclosed, for example, in EP 0 796 920 A1. This apparatus, having a field of nozzles made of an exchangeable nozzle plate provided with nozzles, uses a rotating or swiveling arrangement of nozzle plate and/or of a grate carrying the workpieces. This makes possible relative movement of nozzle field and workpieces and thus ensures that the gas is applied to the workpieces in a relatively uniform manner, but it has the disadvantage that the flow of gas strikes the workpieces in a diffuse and turbulent manner. This means that the surface of each workpiece is cooled unevenly, so that stresses occur that can lead to distortion or even fissures. In particular with workpieces with an offset or undulating shape, or those that are projectingly stacked when a lot or charge is assembled, for example, roller bearing rings or toothed wheels, distortion is particularly noticeable and, due to the generally narrow tolerances for such workpieces, leads not infrequently to a number of rejects that is unsatisfactory in terms of economics.

It is well-known for systematically controlling the flow of gas, to provide guides with which, for example, the quenching gas can strike even those locations of the workpiece surface that would otherwise be located in the shadows of the flow; however, such a measure is not satisfactory because, in addition to the relatively high degree of complexity associated with arranging the guides to correspond to the workpiece geometry, the guides do not prevent eddies from occurring when the flow of gas strikes the workpieces, which can have a negative effect on how adjacent workpieces in a charge cool and can thus cause distortion.

It is therefore an object of the present invention to provide a method and an apparatus for thermal treatment of metallic workpieces with which gas quenching can be obtained that is low in distortion, even for workpieces having an undulating shape or workpieces that are projectingly stackable.

SUMMARY OF THE INVENTION

This object is inventively achieved in a method of the aforementioned general type in that quenching gas is intentionally caused to flow in a directed manner around workpieces by means of guide channels that have a closed lateral surface and that enclose the workpieces along the direction of flow of the quenching gas.

Such a method ensures that quenching gas can be used for low-distortion cooling of the workpieces when guide channels separate the individual workpieces of a charge to be cooled or the workpieces of a charge to be cooled that are placed upon each to form stacks. This results in a flow of gas in the guide channels that flows around the entire workpiece surface parallel to the axis of the workpiece and effects uniform cooling but is not affected by adjacent workpieces.

It is expedient if the guide channels, prior to the heating, are placed over the individual workpieces or the workpieces that are placed upon each other for stacking. In this manner the guide channels are subjected to the thermal treatment together with the workpieces. Even if such a measure requires guide channels made of a suitable heat-resistant material, it offers the advantage that the guide channels can be placed over workpieces that are still cold and can be used in conventional quenching chambers or the workpieces can be quenched in the thermal treatment oven.

Alternatively, the guide channels in the quenching chamber can be arranged around the individual, previously heated workpieces, or the previously heated workpieces that are placed upon each other for stacking, in order to prevent a problem when the workpieces are being heated. In this case it is especially advantageous to place the guide channels over the workpieces in the quenching chamber, for example, via an electromotor, hydraulically, or pneumatically, from one or two sides, preferably from above and/or below, so that manageable operation is ensured even when there is a limited amount of space in the quenching chamber.

Suggested in addition for achieving the aforesaid object is an apparatus for the thermal treatment of metallic workpieces and having a quenching chamber in which the workpieces can be cooled with a quenching gas, the quenching chamber being distinguished in that guide channels are provided to ensure that the quenching gas flows around the workpieces, wherein the guide channels have a closed lateral surface and enclose the workpieces along the direction of flow of the quenching gas.

The method in accordance with the invention can be performed with an apparatus embodied in such a manner. Due to the closed lateral surface of the guide channels, the workpieces are completely enclosed along the direction of flow of the quenching gas and are separated from adjacent workpieces in the charge that is to be cooled. Therefore, a largely laminar flow results that is unaffected by adjacent workpieces and that cools the workpieces intensively and uniformly.

It is of particular advantage if the length of the guide channels is at least equal to the height of the individual workpieces or the workpieces stacked upon each other. This channels the eddying of the quenching gas, which is unavoidable when the quenching gas strikes the workpieces, so that it does not affect the flow of gas around adjacent workpieces. In this regard, it has proven particularly effective to configure the length of the guide channels such that they project beyond the height of the individual workpieces, or of the workpieces stacked upon each other, by an amount equal to half the diameter or width of the workpieces.

In a further advantageous embodiment of the apparatus in accordance with the invention, the shape of the guide channels is cylindrical, preferably with a circular, square, or polygonal cross-section, or is adapted to the geometry of the workpieces to be cooled, in order to provide cost-effective production and furthermore in order to provide intensive quenching by means of a high gas speed caused by a narrow distance between the interior surface of the guide channels and the workpieces.

With respect to manageability, it is additionally useful to interconnect the guide channels to form a system of channels so that it is possible to place all of the guide channels onto the individual workpieces or the workpieces arranged for stacking at one time. This is done primarily when, in accordance with an additional advantageous further development of the apparatus in accordance with the invention, the guide channels are arranged to be adjustable in the quenching chamber, preferably by an electromotor, hydraulically, or pneumatically, for example, in the form of a system of channels that can be lowered onto the workpieces from above. The guide channels are also advantageously exchangeable in order to ensure that it is possible to adapt to different workpiece geometries.

Pursuant to a further embodiment of the invention, the quenching chamber can have an inlet for the quenching gas, said inlet being adjacent to the guide channels. This offers the advantage that the flow of gas forwarded to the quenching chamber flows exclusively into the guide channels and not past the charge of workpieces or between the individual guide channels. In addition, this reduces the flow volume to a minimum. The result is that a high speed is maintained and therefore high quenching intensity is obtained. Finally suggested is that the guide channels comprise a heat-resistant material, preferably steel, iron alloys, or nickel alloys, in order to be able to place them over the workpieces even prior to providing thermal treatment to the workpieces.

BRIEF DESCRIPTION OF THE DRAWINGS

The object and advantages of the present invention will appear more clearly from the following specification in conjunction with the accompanying schematic drawings, in which.

DESCRIPTION OF PREFERRED EMBODIMENTS

Figure 1:
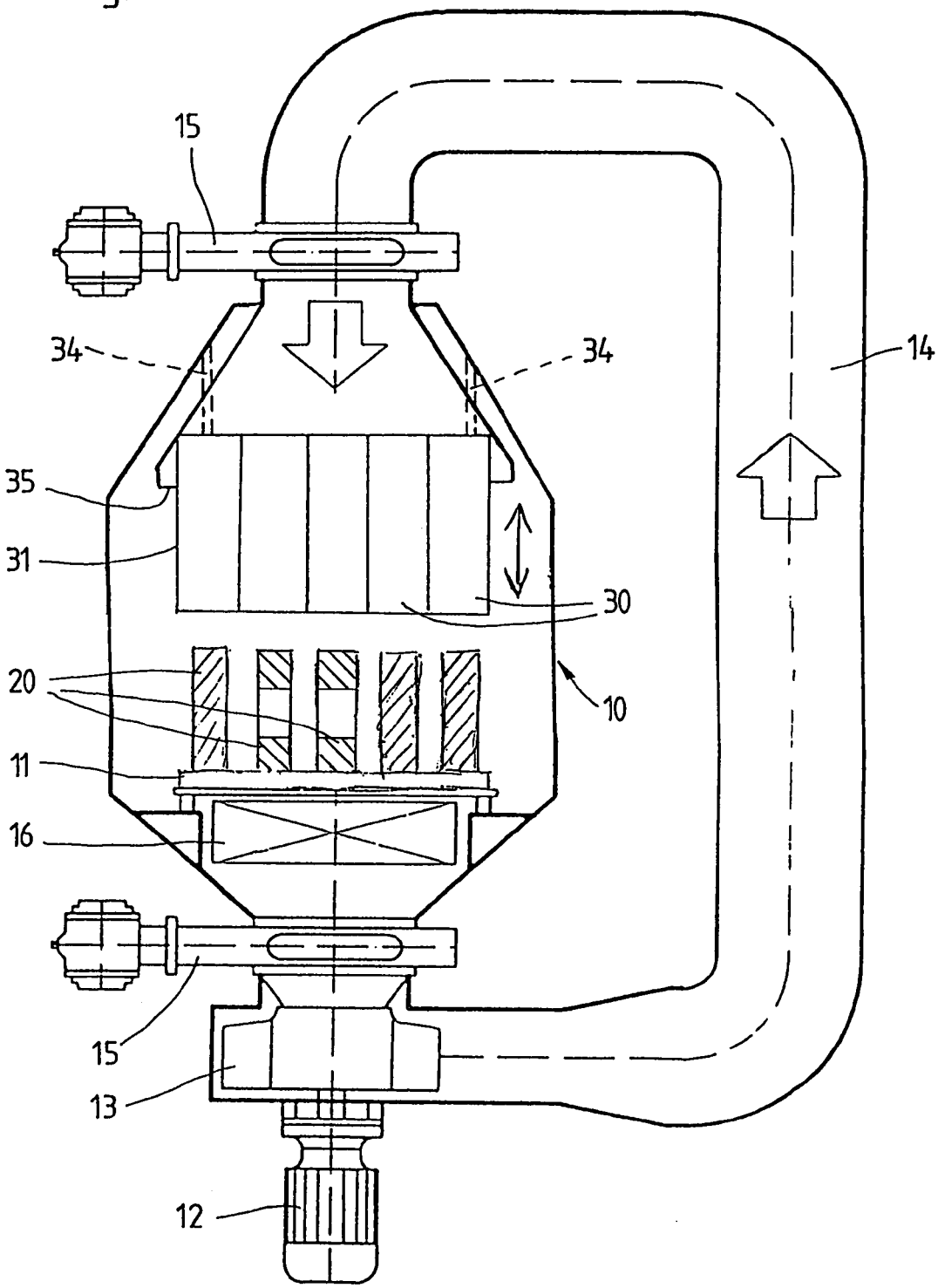
FIG. 1 illustrates a quenching chamber with a raised system of channels.
Figure 2:
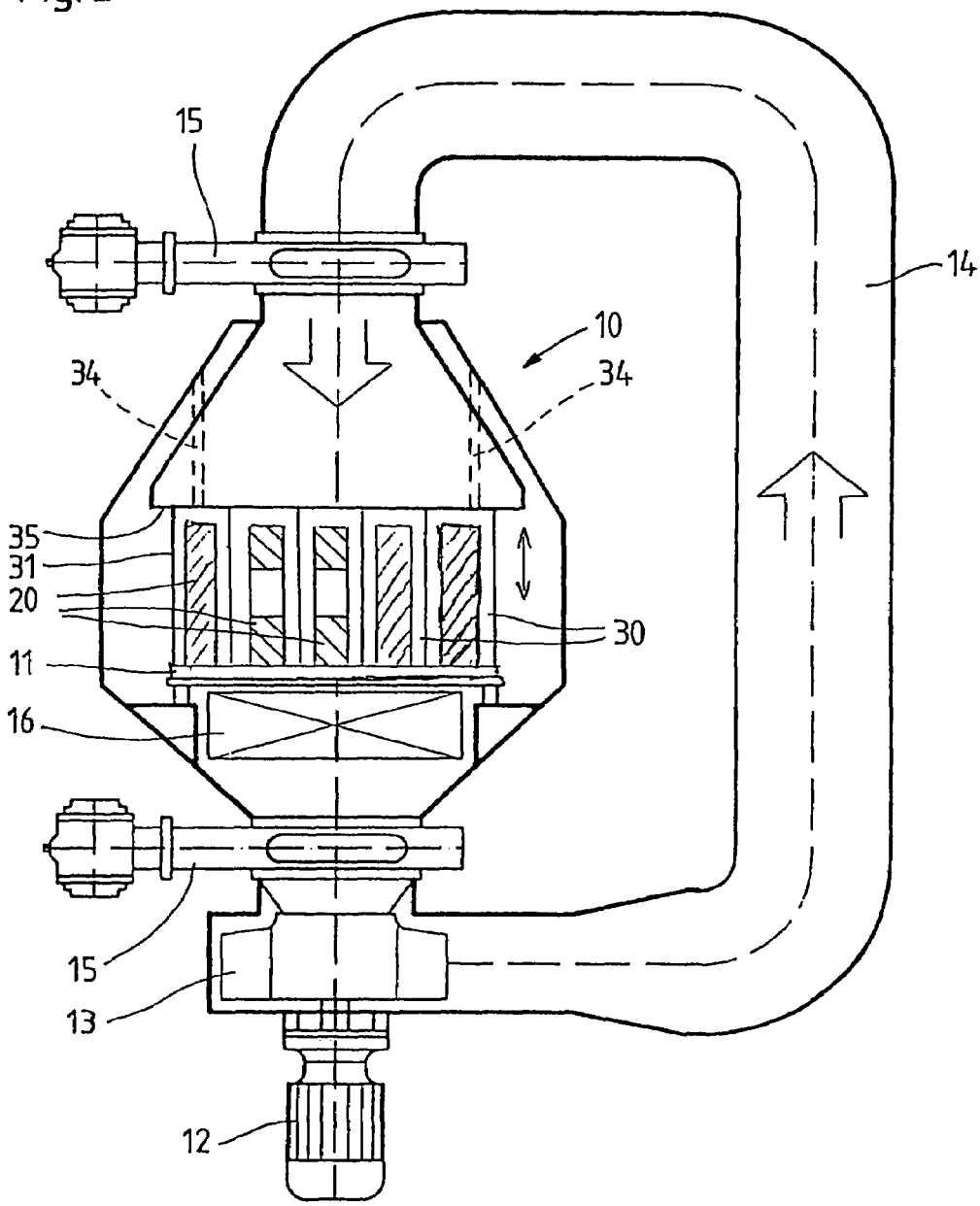
FIG. 2 illustrates the quenching chamber in accordance with FIG. 1 in which the system of channels has been lowered over the workpieces.

The quenching chamber 10 illustrated in FIGS. 1 and 2 is part of an apparatus for the thermal treatment of metallic workpieces 20 and is arranged, for example, at the end of a roller hearth-type furnace. The quenching chamber 10 can be embodied such that it can be operated either with a vacuum or at atmospheric pressure or at overpressure. Located in the quenching chamber 10 is a grate or grid 11 carrying workpieces 20 that have been heated and are to be cooled; the grate makes it possible for a quenching gas to circulate vertically in the quenching chamber 10. For circulating the quenching gas, a fan 13 driven by a motor 12 is arranged below the grate 11. Outside of the quenching chamber 10, the quenching gas is conducted through a gas channel 14 in the direction of flow indicated by the arrow in FIGS. 1 and 2. Furthermore provided above and below the quenching chamber 10 are flaps or the like 15 that prevent the quenching gas from circulating until the fan 13 has achieved the speed required.

Thus, when the flaps 15 are open the quenching gas can circulate by flowing from the fan 13 through the gas channel 14 into the quenching chamber 10 and over the workpieces 20. The quenching gas is re-cooled when it flows over a heat exchanger 16 arranged in front of the fan 13 in the direction of flow, and finally returns to the fan 13.

Figure 3:
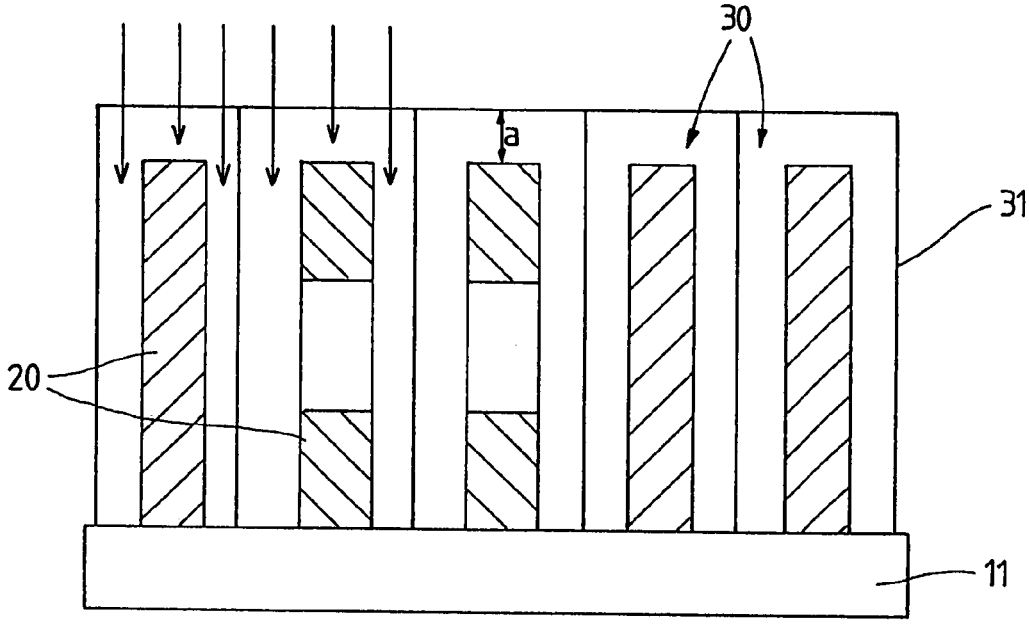
FIG. 3 is a side view of the system of channels in accordance with FIG. 2 comprising inter connected guide channels.
Figure 3A:
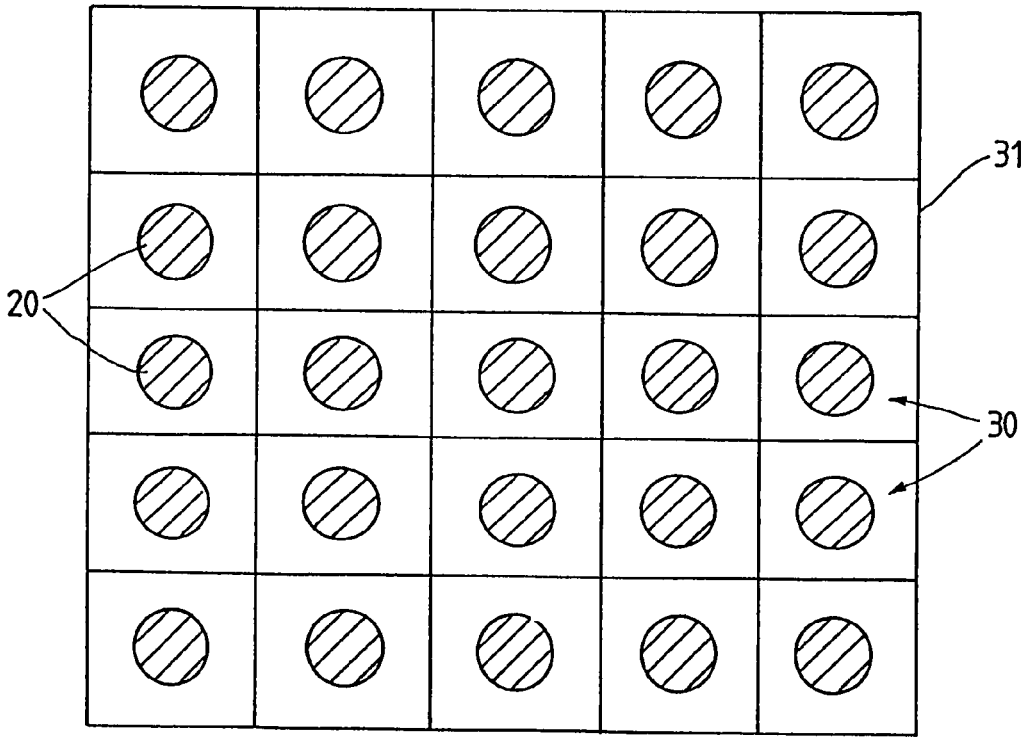
FIG. 3*a* is a top view of the system of channels in accordance with FIG. 3.
Figure 4:
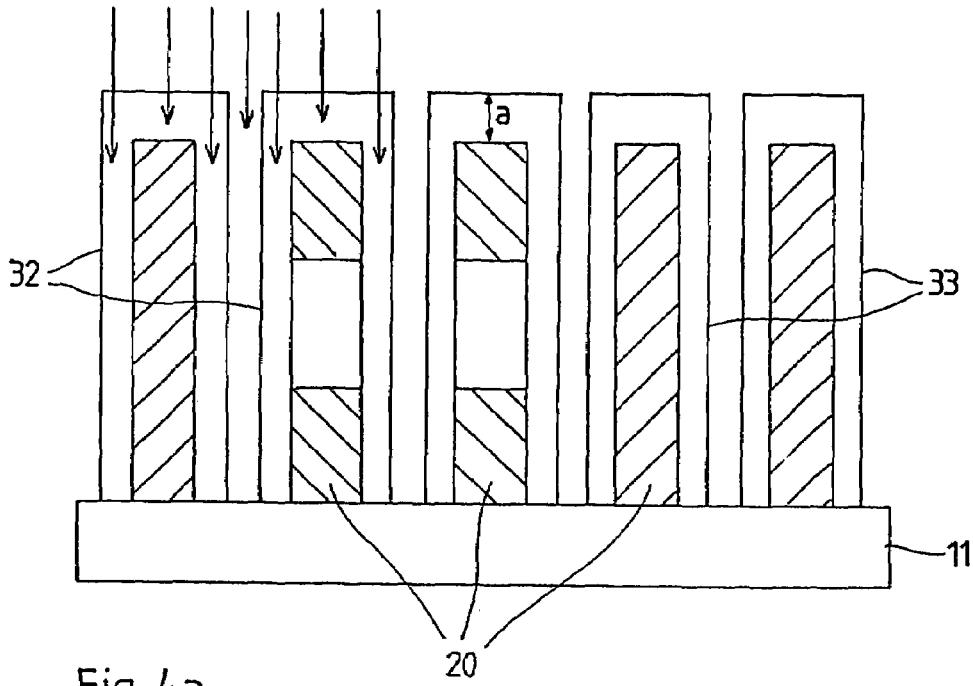
FIG. 4 is a side view of individual guide channels placed over the workpieces; and, FIG. 4*a* is a top view of the guide channels in accordance with FIG. 4.
Figure 4A:
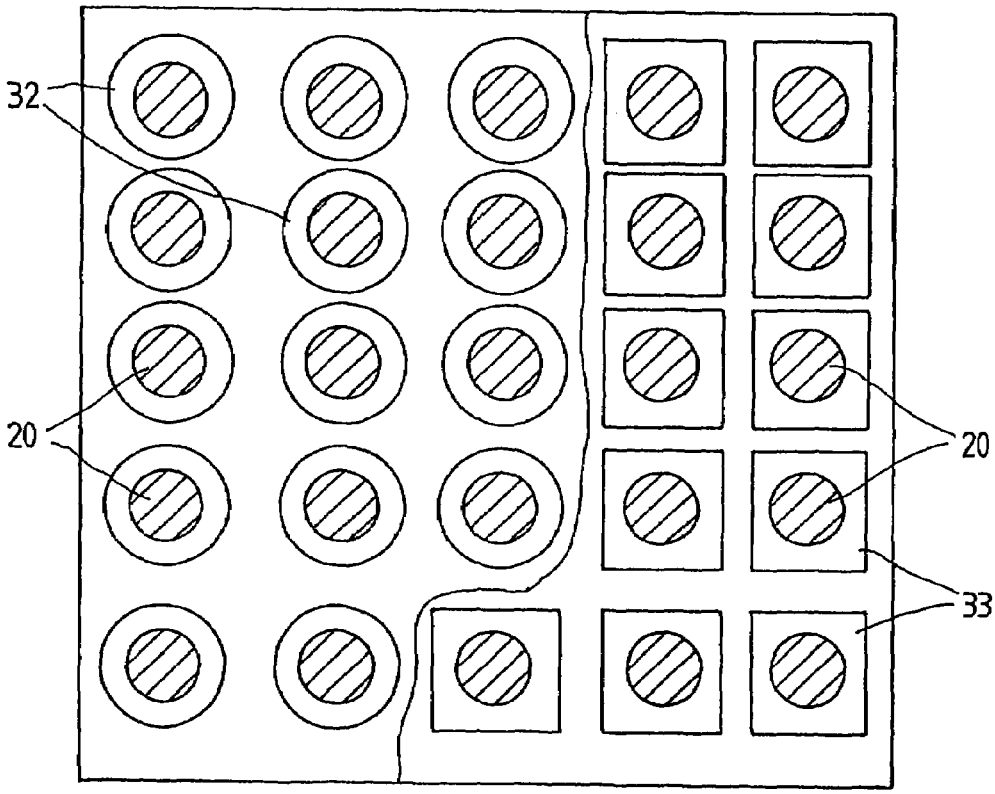

In order to ensure an intentional flow of the quenching gas around the workpieces 20, guide channels 30 are provided that are made of a heat-resistant material, that have a closed lateral surface, and that enclose the workpieces 20 along the direction of flow of the quenching gas. The guide channels 30 can be formed by a coherent, matrix-like system of channels 31, whereby the guide channels 30 are interconnected, as is illustrated in particular in FIGS. 3 and 3*a*. Alternatively, the guide channels 30 can also be embodied as individual hollow cylinders 32, 33 with, for example, a circular or square cross-section. Such embodiments are shown in FIGS. 4 and 4*a*. The length of the guide channels 30 should be configured such that they project beyond the height of the individual workpieces 20 or the workpieces 20 to be stacked by the distance a, as can be seen in FIGS. 3 and 4. The distance a is equal to half the diameter or width of the workpieces 20.

The guide channels 30 can be placed over the workpieces 20 either prior to introducing the workpieces 20 into the quenching chamber 10, for example, when the charge is assembled, or they can be placed thereover in the quenching chamber 10 itself. FIGS. 1 and 2 illustrate the latter instance. The guide channels 30, embodied as a coherent system of channels 31, in this case are arranged in the quenching chamber 10 such that their height can be adjusted by means of hydraulic cylinders 34, as indicated by the double arrow in FIGS. 1 and 2. In this manner, it is possible to place the system of channels 31 over the workpieces 20 from above after the workpieces 20 have been brought into the quenching chamber 10. In order to be able to accommodate charges that have workpieces 20 with different geometries, the system of channels 31 is exchangeably attached to the hydraulic cylinders 34. In addition, provided in the upper part of the quenching chamber 10 is an inlet 35 that seals the system of channels 31 relative to the interior area of the quenching chamber 10 so that the quenching gas circulating in the quenching chamber 10 flows only through the guide channels 30 and does not flow outside the charge of workpieces.

The apparatus described in the foregoing is particularly well-suited for quenching, in an efficient and distortion-free manner, workpieces 20 with an overset or undulating shape or projectingly stackable workpieces, such as shafts or bearing rings that are stacked upon each other. The reason for this is the high speed and laminar flow of the quenching gas effected by the guide channels 30. In addition, the height-adjustable arrangement of the system of channels 31 ensures that the method is manageable and efficient. In addition, the option of providing differently embodied guide channels 30 and the arrangement of the system of channels 31, which is exchangeable for this purpose, allows an adaptation to different workpiece shapes and sizes without complex refitting.

The specification incorporates by reference the disclosure of European priority document EP 00 10 8203.1 of Apr. 14, 2000.

The present invention is, of course, in no way restricted to the specific disclosure of the specification and drawings, but also encompasses any modifications within the scope of the appended claims.

We claim:

1. An apparatus for the thermal treatment of metallic workpieces or a plurality of stacks formed of metallic workpieces arranged one above the other, said apparatus comprising:

a quenching chamber for receiving preheated workpieces and a quenching gas for cooling same;

guide channels each for guiding a directed flow of quenching gas about a respective one of said workpieces or said stacks of said workpieces, wherein each of said guide channels has a closed lateral surface and a length that corresponds at least to a height of the respective individual or stacked ones of said workpieces and each of said guide channels surrounds a respective one of said individual workpieces or said stacks of said workpieces along a direction of flow of said quenching gas such that the respective guide channel guides said quenching gas to flow longitudinally past the respective one of said workpieces or said stacks of said workpieces; and a quenching gas closed loop circulation assembly associated with said quenching chamber for circulating said quenching gas along a closed loop circulation path through said quenching chamber.

2. An apparatus according to claim 1, wherein the length of said guide channels projects beyond a height of said individual or stacked workpieces by an amount equal to half of a diameter or width of said workpieces.

3. An apparatus according to claim 1, wherein said guide channels have a cylindrical shape or are adapted to the geometry of said workpieces that are to be cooled.

4. An apparatus according to claim 3, wherein said guide channels are cylindrical, having a circular, square or polygonal cross-section.

5. An apparatus according to claim 1, wherein said guide channels are interconnected to form a channel system.

6. An apparatus according to claim 1, which includes means for displacing said guide channels in said quenching chamber.

7. An apparatus according to claim 6, wherein said guide channels are replaceable.

8. An apparatus according to claim 1, wherein said quenching chamber is provided with an inlet for said quenching gas, wherein said inlet rests sealingly against said guide channels.

9. An apparatus according to claim 1, wherein said guide channels are made of a heat-resistant material.

10. An apparatus according to claim 9, wherein said guide channels are made of steel, iron alloys or nickel alloys.

11. An apparatus for the thermal treatment of metallic workpieces, said apparatus comprising:

a quenching chamber for receiving preheated workpieces and a quenching gas for cooling same; and means for guiding individual substantially laminar flows of quenching gas around said workpieces in a manner such that each respective individual flow of quenching gas around a respective one of said workpieces remains out of contact with the other respective individual flows of quenching gas during its flow around the respective workpiece, wherein each individual flow of quenching gas is substantially laminar due to the absence of turbulence-generating mixing which would otherwise occur if the flows of quenching gas were not prevented from mixing with one another, said means for guiding individual substantially laminar flows of quenching gas including a plurality of guide channels each having a closed lateral surface and being disposable in surrounding relationship around a respective one of said workpieces for directing a substantially laminar flow of quenching gas around the respective workpiece.

12. An apparatus according to claim 11, wherein said guide channels have a length that corresponds at least to a height of individual or stacked ones of said workpieces.

13. An apparatus according to claim 12, wherein the length of said guide channels projects beyond a height of said individual or stacked workpieces by an amount equal to half of a diameter or width of said workpieces.

14. An apparatus according to claim 11, which includes means for displacing said guide channels in said quenching chamber.

* * * * *